US008967238B2

(12) United States Patent
Meschke et al.

(10) Patent No.: US 8,967,238 B2
(45) Date of Patent: Mar. 3, 2015

(54) PLATE HEAT EXCHANGER, METHOD FOR ITS PRODUCTION, AND ITS USE

(75) Inventors: Frank Meschke, Buchenberg (DE); Armin Kayser, Buchenberg (DE)

(73) Assignee: 3M Innovative Properties Company, St. Paul, MN (US)

( * ) Notice: Subject to any disclaimer, the term of this patent is extended or adjusted under 35 U.S.C. 154(b) by 1337 days.

(21) Appl. No.: 12/225,425

(22) PCT Filed: Mar. 22, 2007

(86) PCT No.: PCT/EP2007/002565

§ 371 (c)(1),
(2), (4) Date: Dec. 9, 2008

(87) PCT Pub. No.: WO2007/110196

PCT Pub. Date: Oct. 4, 2007

(65) Prior Publication Data

US 2009/0151917 A1 Jun. 18, 2009

(30) Foreign Application Priority Data

Mar. 23, 2006 (DE) ..... 10 2006 013 503

(51) Int. Cl.
*F28F 3/00* (2006.01)
*F28D 9/00* (2006.01)
(Continued)

(52) U.S. Cl.
CPC ..... *F28D 9/005* (2013.01); *F28F 3/048* (2013.01); *F28F 13/12* (2013.01); *F28F 21/04* (2013.01); *F28F 2250/04* (2013.01)
USPC ..... 165/166; 165/170

(58) Field of Classification Search
CPC ..... F28D 1/035; F28D 1/0383; F28D 1/03; F28D 1/08; F28F 3/12; F28F 3/06; F28F 3/046; F28F 3/048; F28F 3/027; F28F 13/12; F28F 13/02; F28F 13/003
USPC ..... 165/166, 165, 167, 168, 170, 102, 153, 165/109.1; 422/601, 602
See application file for complete search history.

(56) References Cited

U.S. PATENT DOCUMENTS 1,770,254 A * 7/1930 Seligman ..... 165/103
2,705,617 A * 4/1955 Gosta ..... 165/181
(Continued)

FOREIGN PATENT DOCUMENTS

EP 0 094 876 A1 11/1983
EP 1 544 565 A2 6/2005
(Continued)

*Primary Examiner* — Tho V Duong
(74) *Attorney, Agent, or Firm* — Nath, Goldberg & Meyer; Jerald L. Meyer; Katelyn J. Bernier

(57) ABSTRACT

The invention relates to a plate heat exchanger composed of a plurality of plates (1), preferably made from sintered ceramic material, in which fluid-flow guide channels (2) are formed as a system of channels in such a way that a substantially meandering profile of the fluid flow is obtained over the surface area of the respective plate, the side walls (3) of the guide channels (2) having a plurality of apertures (4), which lead to turbulence of the fluid flow.
The invention also relates to a method for the production of such a plate heat exchanger, in particular by a diffusion welding process in which the plates are joined to form a seamless monolithic block.
The plate heat exchanger according to the invention is suitable in particular for applications at high temperatures and/or with corrosive media, and also as reactors.

26 Claims, 3 Drawing Sheets

(51) Int. Cl.

| | |
|---|---|
| ***F28F 3/04*** | (2006.01) |
| ***F28F 13/12*** | (2006.01) |
| ***F28F 21/04*** | (2006.01) |
| *F28F 3/14* | (2006.01) |

(56) References Cited

U.S. PATENT DOCUMENTS

| | | | | | |
|---|---|---|---|---|---|
| 3,155,565 | A | * | 11/1964 | Hugh | 159/49 |
| 4,099,928 | A | * | 7/1978 | Norback | 29/890.039 |
| 4,551,436 | A | * | 11/1985 | Johnson et al. | 264/6 |
| 4,574,876 | A | * | 3/1986 | Aid | 165/46 |
| 4,997,031 | A | * | 3/1991 | Kashiwada et al. | 165/282 |
| 5,843,385 | A | * | 12/1998 | Dugan | 422/602 |
| 6,357,396 | B1 | * | 3/2002 | Stansfield et al. | 122/7 R |
| 6,959,492 | B1 | * | 11/2005 | Matsumoto et al. | 29/890.039 |
| 7,651,669 | B2 | * | 1/2010 | Wegeng et al. | 422/504 |
| 2002/0106311 | A1 | * | 8/2002 | Golbig et al. | 422/130 |
| 2005/0039898 | A1 | * | 2/2005 | Wand et al. | 165/167 |

FOREIGN PATENT DOCUMENTS

| | | | |
|---|---|---|---|
| FR | 2 314 461 | A1 | 1/1977 |
| WO | WO 81/00617 | A1 | 3/1981 |

* cited by examiner

PLATE HEAT EXCHANGER, METHOD FOR ITS PRODUCTION, AND ITS USE

FIELD OF THE INVENTION

The invention relates to a plate heat exchanger composed of a plurality of plates, preferably made from sintered ceramic material, a method for the production of such a plate heat exchanger and the use of such a plate heat exchanger as a high-temperature heat exchanger and/or for use with corrosive media, and also as a reactor.

BACKGROUND OF THE INVENTION

Heat exchangers are intended to make it possible to obtain a heat transfer between two media flowing separately from each other in a particularly effective manner, that is to say they are intended to transfer as much heat as possible with the least possible exchange area. At the same time, they are intended to offer only little resistance to the substance flows, in order that least possible energy has to be expended for operating the pumps used for delivery. If highly aggressive or corrosive media are passed through the heat exchanger, possibly even at elevated temperatures of over 200° C., all the materials in a heat exchanger that are in contact with the medium must be adequately resistant to corrosion. This includes not only the exchange areas but also all the seals and bushings. Furthermore, the structure of heat exchangers should be made such that, if necessary, complete emptying of the heat exchanger is easily possible, for example for maintenance work.

Plate heat exchangers are a special form of heat exchangers. They are distinguished by a particularly compact design. The plates of a plate heat exchanger generally have in the region of the exchange area an embossed or grooved structure, often also referred to as a herringbone pattern or chevron pattern. The embossing imparts strong turbulence to the medium flowing in the gap between two neighboring plates, which is conducive to the heat transfer. At the same time, such a structure offers relatively little flow resistance to the medium. This is largely in keeping with effective heat transfer with least possible pressure loss.

The plates usually rest loosely on one another at the edges and are separated by seals. Since plastic seals can only be used at temperatures no higher than 300° C., in the case of heat exchangers with plates made from metallic materials, for higher operating temperatures or pressures, the plates are brazed or welded to one another at the edge.

The gap between two neighboring plates respectively forms a sealed chamber. Along with the embossing of the plates, the volume of the chambers is a crucial factor in determining pressure loss and efficiency in the heat transfer. A large chamber volume is conducive to both and therefore desirable. However, this is also at the expense of an operational risk. If no supporting segments are used in the chambers, the unforeseen buildup of a great difference in pressure between neighboring chambers may cause strong deformation of the metal plates or, in the case of brittle materials, easily result in plate rupture. Heat exchanger plates of this form are produced from metallic materials, in particular from corrosion-resistant steels, titanium or tantalum. Graphite is also commercially used.

Sintered SiC ceramic (SSiC) is a universally corrosion-resistant, but brittle material, which is free from metallic silicon, by contrast with silicon-infiltrated silicon carbide (SiSiC) SSiC is ideally suited as a material for the exchange area of heat exchangers on account of its very high thermal conductivity. Moreover, SSiC can also be used at high temperatures up to far above 1000° C. By contrast with SiSiC, SSiC is also resistant to corrosion in hot water or strongly basic media.

In spite of its fundamentally good suitability for heat exchangers, sintered SiC ceramic (SSiC) is currently still not commercially used in plate heat exchangers, but if at all in shell-and-tube heat exchangers. The reason for this is that so far there has been no available design and no available production process that are appropriate for ceramic and make it possible to produce plate heat exchanger components from SSiC for apparatuses with adequate heat transfer performance and the required low pressure loss.

PRIOR ART

DE 28 41 571 C2 describes a heat exchanger of ceramic material with L-shaped media conduction, with Si-infiltrated SiC ceramic (SiSiC) or silicon nitride preferably being used as materials. These materials are disadvantageous insofar as they are not universally resistant to corrosion. In hot water or strongly basic media, the metallic silicon used as a binding phase for infiltration and sealing in the SiSiC dissolves out. Leakage flows and losses in strength are the consequence. In the case of silicon nitride, the grain boundaries are attacked relatively quickly and the surface gradually breaks up.

The structural design proposed in DE 28 41 571 C2 is disadvantageous insofar as the heat exchanger is made up of a large number of elements of different geometries and consequently does not have a modular type of structure that can be uncomplicatedly extended. Furthermore, this type of structure necessitates a large number of joints. Owing to the pressureless sintering process for the materials used, there is an increased risk of leakages occurring in the heat exchanger block. Furthermore, with the chosen channel design, a great pressure loss occurs and the heat exchanger has only a low heat transfer performance.

As an alternative material, DE 197 17 931 C1 describes a fiber reinforced ceramic (C/SiC or SiC/SiC) for use in heat exchangers at high temperatures of 200-1600° C. and/or with corrosive media. These materials are much more complex and cost-intensive to produce than SSiC. Moreover, the ceramic fiber composite materials C/SiC and SiC/SiC are generally porous throughout, precluding hermetic sealing. These disadvantages also cannot be overcome by additional, complex and very expensive surface impregnation.

As a variant of this, EP 1 544 565 A2 describes the use of fiber reinforced ceramic or of SiC specifically for the plates of a high-temperature plate heat exchanger. The channel structure of the plates described in it has fins or ribs and is designed specifically for hot gases to flow through, in particular for gas turbines. When this structural design is used for liquid media, the efficiency would not be good and the pressure loss would be too great. The plate heat exchanger is also produced by means of solution casting and joined by means of brazing. However, brazed joints are always weak points when corrosive media are used, so that such a heat exchanger is not suitable for use with highly corrosive media, such as for example alkaline solutions.

EP 0 074 471 B1 describes a production process for a ceramic plate heat exchanger by means of solution casting and lamination. The laminating process is specifically designed for SiSiC as the material and liquid siliconization during production. FIG. 2 of this patent specification shows an embodiment of a gas-heating heat exchanger in which chicanes intended to bring about a uniform temperature distribution in the flow channels are provided perpendicularly to the direction of flow. However, the heat transfer performance and the pressure loss in the case of this heat exchanger are still not satisfactory.

Object of the Invention

The invention is therefore based on the object of providing a plate heat exchanger with improved heat transfer performance and reduced pressure loss that is also suitable, if required, for use at high temperatures and/or with corrosive media. Furthermore, a method for the production of such a heat exchanger is to be provided.

SUMMARY OF THE INVENTION

The above object is achieved according to the invention by a plate heat exchanger composed of a plurality of plates according to claim 1, a method for the production of such a plate heat exchanger according to claims 19 and 20, and the use of the plate heat exchanger according to claims 22 and 23. Advantageous and particularly expedient refinements of the subject matter of the application are provided in the subclaims.

The subject matter of the invention is consequently a plate heat exchanger composed of a plurality of plates in which fluid-flow guide channels are formed as a system of channels in such a way that a substantially meandering profile of the fluid flow is obtained over the surface area of the respective plate, the side walls of the guide channels having a plurality of apertures, which lead to turbulence of the fluid flow.

The subject matter of the invention is also a method for the production of such a plate heat exchanger, the individual plates being stacked and respectively connected to one another by means of peripheral seals.

The subject matter of the invention is similarly a method for the production of such a plate heat exchanger, the individual plates being stacked and joined to form a seamless monolithic block in a diffusion welding process in the presence of an inert gas atmosphere or in a vacuum at a temperature of at least 1600° C. and possibly with a load being applied.

The plate heat exchanger according to the invention is suitable as a high-temperature heat exchanger and/or for use with corrosive media.

The plate heat exchanger according to the invention can similarly be used as a reactor with at least two separate fluid circuits.

Furthermore, the plate heat exchanger according to the invention is suitable as a reactor, one or more reactor plates being additionally provided between the plates, the reactor plates having a system of channels that is different from the plates.

In the individual plates of the plate heat exchanger according to the invention, the fluid-flow conducting channels are formed as a system of channels in such a way that a substantially meandering profile of the fluid flow is obtained over the surface area of the plate, the side walls of the conducting channels having a plurality of interruptions or apertures, which lead to turbulence of the fluid flow. The invention therefore succeeds in making available a design for plates made from brittle materials, such as for instance graphite or glass, preferably made from sintered ceramic materials, in particular from SSiC, that imparts strong turbulence to the media flowing through and thereby makes efficient heat transfer possible, at the same time brings about a low pressure loss, has sufficient supporting points in the exchange area to absorb deformation or brittle rupture when there are differences in pressure, allows complete emptying for maintenance work, allows plastic seals to be easily integrated and at the same time makes it possible to produce a seamless monolithic block from the plates in a diffusion welding process.

A further advantage of the design of the plates according to the invention is that feed and discharge openings for the fluid flows can already be integrated in the plates, for example in the form of bores.

The heat transfer in the case of a plate heat exchanger according to the invention is higher by about 5 to 30% in comparison with plate heat exchangers of the prior art and the pressure loss is up to 30% lower. Particularly the pressure loss is an important criterion in the design of heat exchangers, because it allows the required pumping capacity to be correspondingly reduced.

DETAILED DESCRIPTION OF THE INVENTION

The plate heat exchanger according to the invention has a structure in which a number of plates, preferably made from sintered ceramic material, are stacked one on top of the other. Sintered silicon carbide (SSiC), fiber reinforced silicon carbide, silicon nitride or combinations thereof are suitable as sintered ceramic material, with SSiC being particularly preferred. Preferably, SSiC is used with a bimodal grain size distribution, which according to choice may contain up to 35% volume of further substance components, such as graphite, boron carbide or other ceramic particles, since this material is particularly well-suited for diffusion bonding in a hot pressing process (diffusion welding process). Preferably, the sintered silicon carbide with a bimodal grain size distribution comprises 50 to 90% by volume prismatic, platelet-shaped SiC crystallites of a length of from 100 to 1500 μm and 10 to 50% by volume prismatic, platelet-shaped SiC crystallites of a length of from 5 to less than 100 μm. The measuring of the grain size or the length of the SiC crystallites may be determined on the basis of light microscopy micrographs, for example with the aid of an image evaluation program that determines the maximum Feret's diameter of a grain.

In the case of the plates used according to the invention, the guide channels in the plates are connected to a first feed opening and a first discharge opening for a first fluid. Furthermore, a second feed opening and a second discharge opening may be provided for a second fluid to supply a neighboring plate, it being possible for these openings to be provided in a simple way by bores.

According to a preferred embodiment, a plate of a first plate type comprises a system of channels for a first fluid and a neighboring plate of a second plate type comprises a system of channels for a second fluid. In the case of this embodiment, the plates of the first plate type and the plates of the second plate type may follow one another in any desired sequence, to make variable speed adaptation possible. For this, the plates arranged in parallel or behind the other of one of the two circuits of the heat exchanger are doubled or trebled, in order to make the substance flow that is to be handled flow through the plates at a defined rate. Resultant stack sequences of the heat exchanger plates are, for example, as per A-BB-A-BB . . . or A-BBB-A-BBB . . . .

However, the design of the heat exchanger plates according to the invention also makes a double or multiple mode of operation possible. For this, the plates of one circuit are arranged one behind the other instead of in parallel. The media flowing through consequently has a longer distance available to it for heating up or cooling down.

In the case of a further preferred embodiment, the system of channels of the plates has mirror symmetry. This mirrorsymmetrical design makes it possible for the plates to be stacked one on top of the other such that they are alternately turned by 180° in each case, so that the feed openings are alternately on the left and on the right. This arrangement allows a heat exchanger to be constructed with a single design for all plates, which offers advantages from a production engineering viewpoint.

According to one embodiment, at least two separate systems of channels for different fluids between which heat transfer is to take place may be provided within one plate. It is preferred in this respect that the different fluids are conducted in counterflow in separate systems of channels.

The plates used according to the invention preferably have a base thickness in the range of 0.2 to 20 mm, with particular preference about 3 mm. On the basis of the system of channels according to the invention, the fluid or substance flow in an exchange area of a plate is conducted in a meandering manner, to make the longest possible dwell time possible. The side walls or guide walls of the guide channels in the exchange area preferably have a height, measured from the base of the plate, in the range of 0.2-30 mm, more preferably 0.2-10 mm, and with particular preference 0.2-5 mm. The side walls of the guide channels, formed as webs, can be produced by means of milling, but may also be produced by means of near-net-shape pressing. At defined locations, the side walls of the guide channels have interruptions or apertures, which preferably have a width of 0.2-20 mm, more preferably 2-5 mm. These apertures cause great turbulence of the fluid flow and, with the substantially meandering flow profile, make a high and improved heat transfer efficiency possible. Moreover, these apertures make it possible for the great pressure loss occurring in the case of conventional plate heat exchangers to be reduced considerably. The pressure loss can be set in a desired way by the number and width of the apertures. The apertures also serve to make it possible for the heat exchanger to be completely emptied when it is in an upright position.

Furthermore, the apertured side walls of the guide channels also act as supporting points and, when there are differences in pressure, avoid undesired deformation of the plates and likewise prevent plate rupture.

According to one embodiment of a plate heat exchanger according to the invention, the individual plates are stacked and connected by means of peripheral seals. Customary plastic seals, which can be used up to temperatures of about 300° C., are suitable for this. The type of structure that is connected by means of seals is very inexpensive and is particularly advantageous whenever the heat exchanger has to be disassembled and cleaned for servicing purposes.

According to another embodiment of the plate heat exchanger according to the invention, the individual plates are stacked and integrally joined to form a seamless monolithic block. This monolithic type of structure, in which the plates are connected in a hermetically sealed manner without seals, by means of seamless joining, is advantageous in particular for applications at high temperatures and applications with environmentally hazardous or corrosive media.

According to a further embodiment of the plate heat exchanger according to the invention, at least two of the plates are stacked and integrally joined to form a seamless monolithic block and at least two such monolithic blocks are connected to one another by means of peripheral seals. This so-called semi-sealed embodiment may be expedient in particular when corrosive media are used in one substance circuit and media that have a tendency to form deposits are used in the other substance circuit. For this purpose, the invention provides that the plates for the corrosive medium are sintered to one another at least in pairs and the monolithic plate blocks thereby obtained are stacked such that they are sealed by suitable plastic seals, for example made from elastomer material. This type of plate heat exchanger can always be dismantled, for example to clean the formed deposits from the sealed chambers.

To produce a monolithic block as described above, the individual plates are stacked and joined to form a seamless monolithic block in a diffusion welding process in the presence of an inert gas atmosphere or in a vacuum at a temperature of at least 1600° C., with preference above 1800° C., with particular preference above 2000° C., and possibly with a load being applied, the components to be joined preferably undergoing plastic deformation in the direction of force introduction of less than 5%, more preferably less than 1%. Suitable in particular as the diffusion welding process is a hot pressing process using ceramic sheets of sintered SiC (SSiC), with particular preference of coarse-grained SSiC with a bimodal grain size distribution as mentioned above, which may contain up to 35% by volume of further substance components, such as graphite, boron carbide or other ceramic particles.

The resistance to plastic deformation in the high temperature range is referred to in material science as high-temperature creep resistance. What is known as the creep rate is used as a measure of the creep resistance. It has surprisingly been found that the creep rate of the ceramic sheets to be joined can be used as a central parameter to minimize the plastic deformation in a joining process for seamless joining of the sintered ceramic sheets. Most commercially available sintered SiC materials have microstructures with monomodal grain size distribution and a grain size of about 5 μm. They consequently have adequate sintering activity at joining temperatures of over 1700° C., but have a creep resistance that is too low for low-deformation joining. Therefore, high plastic deformation has so far always been observed in the diffusion welding of such components. Because the creep resistance of the SSiC materials is generally not especially different, the creep rate has not so far been considered as a usable variable parameter for the joining of SSiC.

It has therefore been found that the creep rate of SSiC can be varied over a wide range by variation of the microstructural formation. Low-deformation joining for SSiC materials can therefore only be achieved by the use of specific types, such as those with bimodal grain size distribution. According to the invention, the ceramic sheets to be joined preferably consist of an SSiC material of a creep rate which, in the joining process, is always less than $2\times10^{-4}$ l/s, with preference always less than $8\times10^{-5}$ l/s, with particular preference always less than $2\times10^{-5}$ l/s.

In the case of the diffusion welding used according to the invention, preferably a load of over 10 kPa, with particular preference of over 1 MPa, and with more preference of over 10 MPa, is applied, the temperature holding time at a temperature of at least 1600° C. with preference exceeding a duration of 10 minutes, with particular preference 30 minutes.

Consequently, with the production process according to the invention, plate heat exchangers in which the seals or brazed joints have so far formed the weak points can now be produced as a seamless monolith. The plate heat exchangers produced in this way from sintered SiC ceramic therefore have extremely high thermal and corrosion resistance.

As already mentioned above, the plate heat exchanger with heat exchanger plates configured according to the invention is also suitable as a reactor, for example for evaporation and condensation, but also for other phase transformations, such as for example for specifically chosen crystallization processes. When used for evaporation and condensation, it is preferred for the achievement of a reduced pressure loss if the spacing of the side walls of the conducting channels from one another becomes greater or smaller from the fluid inlet to the fluid outlet.

It is conducive to particularly effective use as a reactor to fit reactor plates between the heat exchanger plates configured according to the invention, the heat exchanger plates then serving for controlling the temperature of the reactor plates. The reactor plates may have various geometries. For a controlled dwell time and defined precipitation reaction, such as for instance for specifically chosen crystallization processes, it is advantageous for example to use reactor plates with straight channels right through. However, at least two initially separate fluid flows can also be mixed with one another at a defined temperature in the reactor plate. For this purpose, channel structures with which the substance flows are brought to each other in a defined region of the reactor plate and intensively mixed are used. The reactor plates may also have suitable catalytic coatings, which specifically accelerate a chemical reaction.

The hermetically sealed heat exchanger blocks according to the invention no longer require the conventional heavy frames for clamping in place and connecting flanges, but need only to be contacted with a corresponding flange system at the supply bores. In the case of one embodiment of the invention, the plate heat exchanger therefore also comprises a ceramic or metallic flanging system for the feed and discharge of fluids on the upper side and/or underside (cover and/or base) of the plate heat exchanger. For high-temperature applications, a mica-based sealing material is used with preference for the sealing of the flanging system.

BRIEF DESCRIPTION OF THE ACCOMPANYING DRAWINGS

Figure 1:
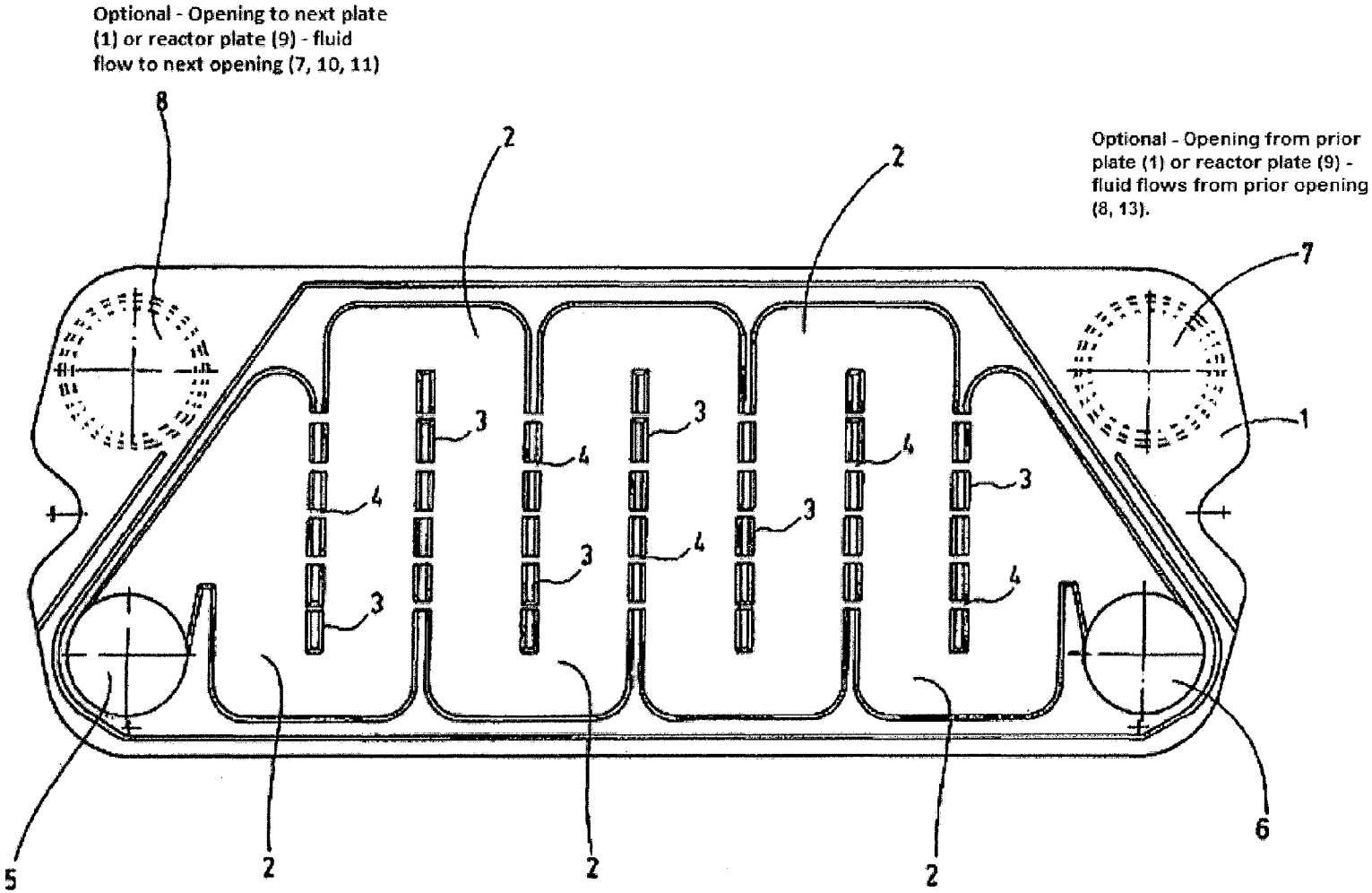
FIG. 1 shows the plan view of a heat exchanger plate used according to the invention and made from sintered ceramic material.

As shown in FIG. 1, a plate 1 that can be used according to the invention has a system of channels which is formed by guide channels 2 and makes possible a substantially meandering profile of the fluid flow over the surface area of the plate. In this embodiment, the side walls 3 of the guide channels 2 comprise webs with a width of 3 mm, which have a multiplicity of apertures 4 with a width of 3.5 mm. The plate also has a first feed opening 5 and a first discharge opening 6 for a fluid flow, respectively in the form of a bore with a radius of 30 mm. Furthermore, a second feed opening 7 and a second discharge opening 8 are provided in the plate, serving as a passage for supplying a neighboring chamber with another medium. The second feed opening and second discharge opening respectively comprise bores with a radius of 32 mm. The overall length of the plate in the case of this embodiment is 500 mm and its width is 200 mm. As can be seen, the system of channels in the case of this embodiment has mirror symmetry. This mirror symmetry makes it possible for the plates to be stacked one on top of the other such that they are alternately turned by 180° in each case, so that the feed openings are alternately on the left and on the right.

Figure 2:
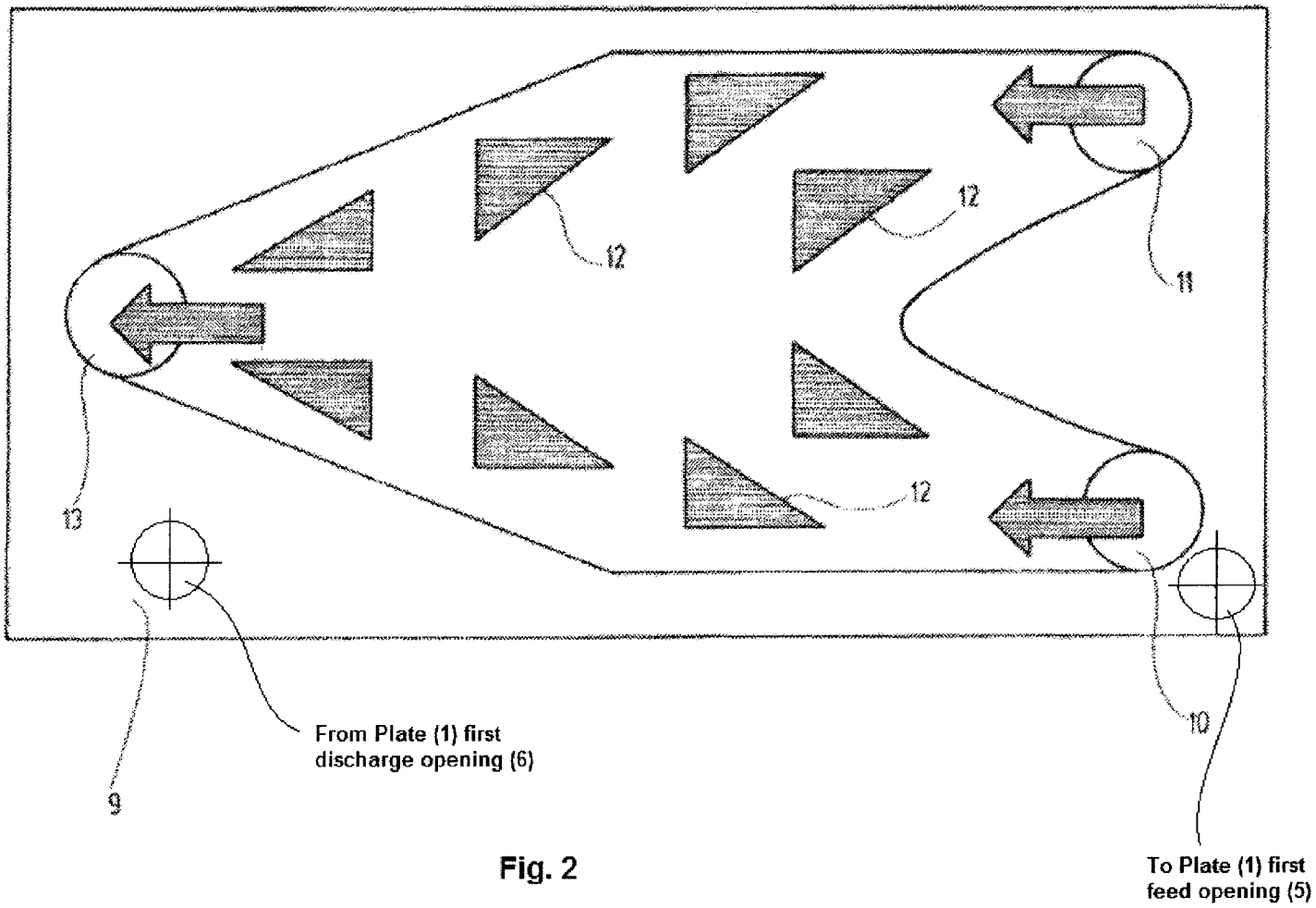
FIG. 2 shows the plan view of a reactor plate used according to the invention.

FIG. 2 shows a reactor plate 9 that can be used according to the invention, with a first feed opening 10 for a first fluid flow and a second feed opening 11 for a second fluid flow. The two fluid flows are then brought to each other by the chicanes 12 in such a way that intensive mixing of the fluid flows takes place.

The mixed fluid flow is then discharged via the discharge opening 13.

Figure 3A:
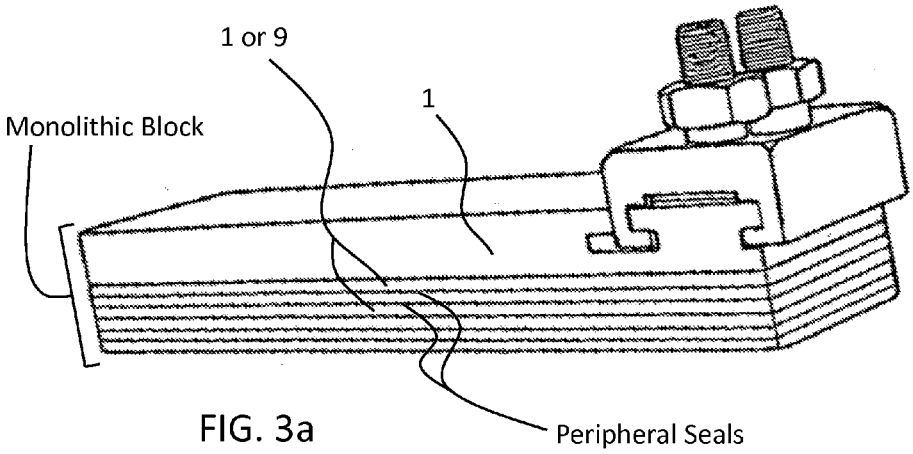
FIGS. 3*a* and 3*b* are photographs of plate heat exchangers according to the invention, including flanging systems.
Figure 3B:
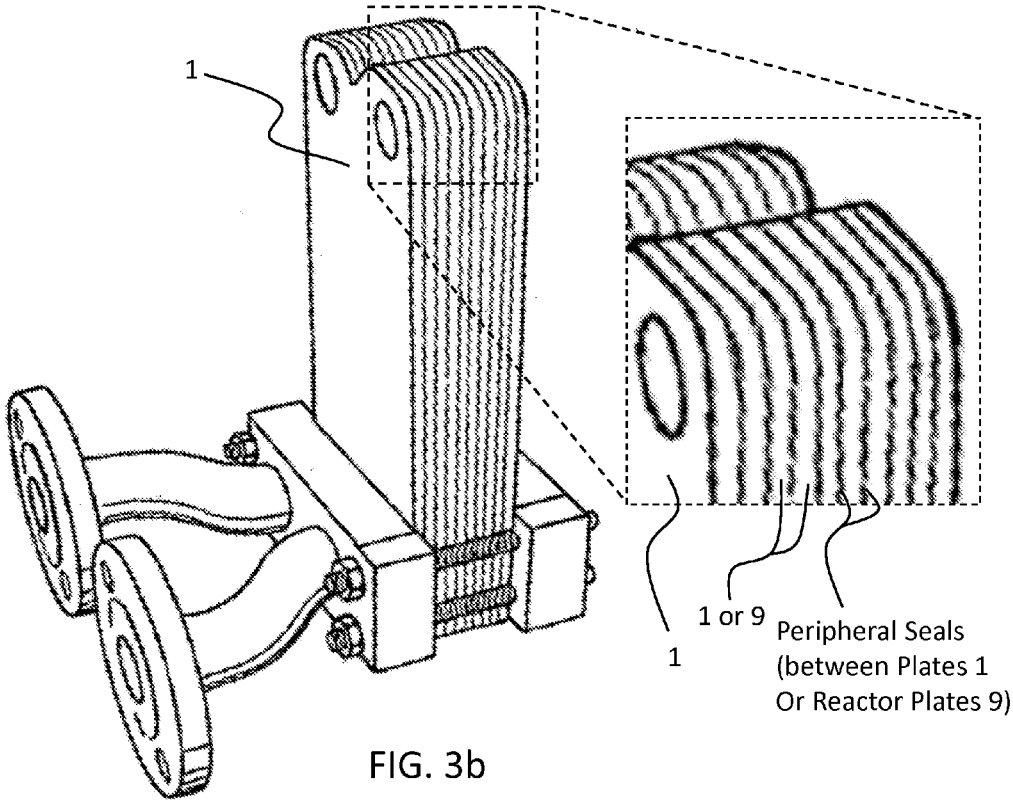

FIGS. 3*a* and 3*b* show how metallic flanges are clamped on a ceramic monolith.

EXAMPLES

The following example serves for further explanation of the invention.

Example of Application of a Heat Exchanger

A ceramic exchanger is produced with heat exchanger plates in the manner of FIG. 1. The plates have a length of 500 mm, a base thickness of 3 mm and guide channels with a height of 3.5 mm. The side walls have apertures of a width of 3 mm. Four heat exchanger plates and one cover plate are used for the production of the heat exchanger block, all the components consisting of sintered silicon carbide with bimodal grain size distribution. All the ceramic plates are stacked and integrally and seamlessly joined to form a monolithic block. The plates are arranged in the block in such a way that two substance flows can exchange heat in counterflow. The hermetically sealed heat exchange block made from sintered silicon carbide is provided with four metallic flanges with an inside diameter of 50 mm. The heat exchanger apparatus is operated with aqueous media. With a throughput of 1000 l/h, there is a pressure loss of 100 mbar and a transfer of 6000 $W/m^2K$.

The invention claimed is:

1. A plate heat exchanger comprising a plurality of plates (1), the plates comprising:

a sintered ceramic material, and fluid-flow guide channels (2) having a series of side walls (3) formed as webs, wherein the guide channels have mirror symmetry, wherein the side walls (3) form a meandering profile of fluid flow over the surface area of a respective plate, the side walls (3) each have a plurality of apertures (4), which lead to turbulence of the fluid flow, and the side walls (3) are positioned as supporting points for the plates to avoid deformation and prevent plate rupture, and wherein at least two plates (1) are stacked and integrally joined as a seamless monolithic block.

2. The plate heat exchanger as claimed in claim 1, wherein the sintered ceramic material further comprises a material selected from the group consisting of sintered silicon carbide (SSiC), fiber reinforced silicon carbide, silicon nitride, and combinations thereof.

3. The plate heat exchanger as claimed in claim 2, wherein the sintered ceramic material further comprises at least sintered silicon carbide with a bimodal grain size distribution, the sintered silicon carbide having a threshold of 35% volume of further substance components.

4. The plate heat exchanger as claimed in claim 3, wherein the sintered silicon carbide with a bimodal grain size distribution comprising 50 to 90% by volume prismatic, platelet-shaped SiC crystallites of a length of from 100 to 1500 μm and 10 to 50% by volume prismatic, platelet-shaped SiC crystallites of a length of from 5 to less than 100 μm.

5. The plate heat exchanger as claimed in claim 1, wherein the fluid-flow guide channels (2) are connected to a first feed opening (5) and a first discharge opening (6) for a first fluid.

6. The plate heat exchanger as claimed in claim 5, wherein the plate further comprises a second feed opening (7) and a second discharge opening (8) for a second fluid to supply a neighboring plate.

7. The plate heat exchanger as claimed in claim 1, a plate of a first plate type comprising a system of channels for a first fluid and a neighboring plate of a second plate type comprising a system of channels for a second fluid.

8. The plate heat exchanger as claimed in claim 7, plates of the first plate type and plates of the second plate type being stacked on one another in any desired sequence.

9. The plate heat exchanger as claimed in claim 1, wherein at least one plate of the plurality of plates comprises at least two separate systems of flow-guide channels for different fluids on opposing sides of the plate and having mirror symmetry, between which heat transfer is to take place.

10. The plate heat exchanger as claimed in claim 9, the different fluids being conducted in counterflow in separate flow-guide channels.

11. The plate heat exchanger as claimed in claim 1, the plates (1) having a base thickness in the range of 0.2-20 mm.

12. The plate heat exchanger as claimed in claim 1, the said side walls (3) of the said guide channels (2) having a height in the range of 0.2-30 mm.

13. The plate heat exchanger as claimed in claim 1, the apertures (4) in the said side walls (3) of the guide channels (2) having a width in the range of 0.2-20 mm.

14. The plate heat exchanger as claimed in claim 1, the plates (1) being stacked and connected to one another by means of peripheral seals.

15. The plate heat exchanger as claimed in claim 1, wherein at least two seamless monolithic blocks are connected to one another by means of peripheral seals.

16. The plate heat exchanger as claimed in claim 1, also comprising a ceramic or metallic flanging system for the feed and discharge of fluids on the upper side and/or underside of the plate heat exchanger.

17. A method for the production of a plate heat exchanger as claimed in claim 1, comprising the steps of stacking the plates (1), connecting the plates (1), and then integrally joining the plates (1) using peripheral seals.

18. A method for the production of a plate heat exchanger as claimed in claim 1, wherein the at least two plates are stacked and integrally joined as a seamless monolithic block in a diffusion welding process in the presence of an inert gas atmosphere or in a vacuum at a temperature of at least 1600° C. and possibly with a load being applied.

19. The use of a plate heat exchanger as claimed in claim 1 as a reactor, one or more reactor plates (9) being additionally provided between the plates (1), the reactor plates (9) having a separate system of guide channels from the plates (1).

20. The use as claimed in claim 19, the reactor plates (9) containing parallel running fluid-flow guide channels, the said side walls of which do not have apertures.

21. The use as claimed in claim 19, the system of channels formed in the reactor plates (9) making it possible for at least two initially separate fluid flows to be mixed.

22. The use as claimed in claim 19, the reactor plates (9) being catalytically coated.

23. The plate heat exchanger as claimed in claim 1, wherein said plates (1) having a base thickness of about 3 mm.

24. The plate heat exchanger as claimed in claim 1, wherein said side walls (3) of the said guide channels (2) having a height in the range of 0.2-10 mm.

25. The plate heat exchanger as claimed in claim 1, wherein said side walls (3) of the said guide channels (2) having a height in the range of 0.2-5 mm.

26. The plate heat exchanger as claimed in claim 1, wherein said apertures (4) having a width in the range of 2-5 mm.

* * * * *